US006199529B1

(12) United States Patent
Kuwabara et al.

(10) Patent No.: US 6,199,529 B1
(45) Date of Patent: Mar. 13, 2001

(54) ENGINE STARTING APPARATUS

(75) Inventors: Shigeaki Kuwabara; Mitsuru Nakamura; Kazuhiro Sato, all of Wako; Keizo Shimizu; Taro Kihara, both of Takasaki, all of (JP)

(73) Assignee: Honda Giken Kogyo Kabushiki Kaisha and Starting Industrial Co., Ltd. (JP)

( * ) Notice: Subject to any disclaimer, the term of this patent is extended or adjusted under 35 U.S.C. 154(b) by 0 days.

(21) Appl. No.: 09/281,087

(22) Filed: Mar. 30, 1999

(30) Foreign Application Priority Data

Mar. 31, 1998 (JP) ..... 10-087389
Mar. 31, 1998 (JP) ..... 10-087390
Mar. 31, 1998 (JP) ..... 10-087408
Mar. 31, 1998 (JP) ..... 10-103974

(51) Int. Cl.[7] ..... F02B 63/04; F02B 67/00
(52) U.S. Cl. ..... 123/179.24; 123/185.3
(58) Field of Search ..... 123/185.2, 185.3, 123/185.4, 179.24, 198 E

(56) References Cited

U.S. PATENT DOCUMENTS 2,939,448 * 6/1960 Hansen ..... 123/179.24
4,157,083 * 6/1979 Smith et al. ..... 123/179.24
4,848,288 * 7/1989 Murase et al. ..... 123/179.24
4,884,535 * 12/1989 Iida et al. ..... 123/179.24
4,922,868 * 5/1990 Ohkanda ..... 123/179.24
4,930,467 * 6/1990 Masuda et al. ..... 123/179.24
5,010,858 * 4/1991 Schierling et al. ..... 123/179.24
5,676,103 * 10/1997 Tsunoda et al. ..... 123/185.3

FOREIGN PATENT DOCUMENTS 63-100674 6/1988 (JP) .
2108854 4/1990 (JP) .
3258969 11/1991 (JP) .
6-23739 6/1994 (JP) .

* cited by examiner

*Primary Examiner*—Henry C. Yuen
*Assistant Examiner*—Arnold Castro
(74) *Attorney, Agent, or Firm*—Adams & Wilks

(57) ABSTRACT

An engine starting apparatus comprises a case having an outer case and a case cover defining an interior space. The outer case has at least first, second and third bolt apertures, for attaching the case to an engine. A motor mounting seat is formed in an inner wall of the outer case for mounting thereon a starter motor for starting the engine. A recoil starter mechanism is disposed in the interior space of the case for starting the engine. The recoil starter mechanism has a starting rope pulling port disposed adjacent to the first bolt aperture. The starter motor is disposed between the first bolt aperture and the third bolt aperture when the starting rope pulling port is positioned between the first bolt aperture and the second bolt aperture, and the starter motor is disposed between the first bolt aperture and the second bolt aperture when the starting rope pulling port is positioned between the first bolt aperture and the third bolt aperture. First louvers extend from an outer surface of the case cover. Second louvers are formed on a wall of the outer case. External air is taken in by the first and second louvers around the entire periphery of the case during operation of the engine.

26 Claims, 9 Drawing Sheets

ENGINE STARTING APPARATUS

BACKGROUND OF THE INVENTION

1. Field of the Invention

The present invention relates to an improvement in an engine starting apparatus started by a self-starter mechanism.

2. Description of the Related Art

There exists a variety of engine starting apparatuses wherein a crankshaft is started by a self-starter mechanism accommodated in a case. Such an engine starting apparatus is disclosed, for example, in Japanese Utility Model Post-Exam Publication No. HEI-6-23739 and Japanese Patent Laid-Open Publication No. HEI-2-108854.

The engine starting apparatus disclosed in Japanese Utility Model Post-Exam Publication No. HEI-6-23739 includes a plurality of supports provided on an outer periphery of an intake aperture formed in a fan cover for covering a cooling fan mounted on a crankshaft of an engine, a cover member attached to ends of the supports, and a self starter connected to the cover member through plural screws such that the crankshaft is connected to an output side of the self starter. A starter motor of the self starter is disposed outside the plural supports. Upon rotation of the cooling fan, external air is taken into gaps between the plural supports to enter into the fan cover through the intake ports, thereby cooling the engine. Further, the engine starting apparatus is designed such that the self starter motor is turned 180 degrees on the engine after the plural screws are removed to detach the self starter from the engine.

However, the starter motor of the aforementioned engine starting apparatus is disposed outside the plural supports in parallel thereto and further protrudes toward the engine. Therefore, when the engine starting apparatus is turned on the engine, the engine and the starter motor bump against each other to thereby limit attachment of the engine starting apparatus to the engine. Consequently, there is a demand for an improvement to prevent the starter motor from bumping against the engine.

An engine starting apparatus disclosed in Japanese Patent Laid-Open Publication No. HEI-2-108854 includes a recoil starter case formed integrally with a starter motor case, a battery case assembled with the former to provide a case unit, and a fan case forming therein an intake port having an outer periphery attached to the case unit through four bolts. The starter motor is disposed oppositely from the engine in parallel to a side wall of the recoil starter case.

In the engine starting apparatus thus arranged, a large number of slit-shaped external air intake apertures for taking external air thereinto are formed in the side wall of the recoil starter case. Upon rotation of a cooling fan mounted on a crankshaft, external air is taken into the fan case through the external air intake apertures formed in the side wall of the recoil starter case to thereby cool an engine body.

However, since the starter motor and the battery case of the engine starting apparatus are mounted on a peripheral portion of the recoil starter case in juxtaposition, the external air intake apertures can not be formed thereat. Thus, it becomes impossible to take in external air throughout the entire periphery of the recoil starter case, thereby making flow of external air taken into the fan case nonuniform. Therefore, the engine body is not cooled uniformly. Consequently, there is a room for improvement to enhance performance for cooling the engine body. Further, partial disposition of the external air intake apertures makes it difficult to increase total cross-sectional area of the plural external air intake apertures. Furthermore, provision of the small total cross-sectional area exerts influence on cooling ability of the engine starting apparatus for the engine body. Accordingly, there is a room for improvement to increase the total cross-sectional area.

Moreover, in the aforementioned engine starting apparatus, the crankshaft is rotated by starting the starter motor. Otherwise, by pulling a lever by hand to unwind a starting rope, a starter wheel is rotated to thereby rotate the crankshaft. However, upon pulling the starting rope, a large pulling force acts on the vicinity of a starting rope pulling port of the recoil starter case. Although the recoil starter case is therefore required to be rigid to withstand the large pulling force, it is also considered that the number of bolts for mounting the recoil starter case to the engine body are increased instead of improving the rigidity of the recoil starter case. However, the increase in the number of bolts not only increases the number of parts corresponding thereto but also invites difficulty in mounting the recoil starter case to the engine body. Moreover, in the case where the starter motor is disposed in close proximity to the starting rope pulling port, the starter motor presents an obstruction to an operation of pulling the starting rope. Therefore, there is a room for improvement in disposition of the rope pulling port and the starter motor.

Further, in Japanese Utility Model Laid-Open Publication SHO-63-100674, there is disclosed an engine starting apparatus including a pinion gear and an output shaft of a starter motor both accommodated in a magneto chamber adjacent to a crankcase of an engine body, and a recoil starter mechanism accommodated in a recoil chamber adjacent to the magneto chamber. Although a recoil reel of the recoil starter mechanism is disposed coaxially with the pinion gear, a partition wall separates the magneto chamber accommodating therein the pinion gear from the recoil chamber accommodating therein the recoil reel of the recoil starter mechanism. The engine starting apparatus is arranged such that a crankshaft is rotated by either the starter motor or a recoil starter by means of the pinion gear and a magneto device meshing with the pinion gear.

The foregoing engine starting apparatus has the pinion gear and the recoil starter, which are accommodated in the respective chambers in the manner as stated above. It is therefore unlikely that lubricating oil clung to the teeth of the pinion gear is scattered to dirty a starting rope of the recoil starter and that the starting rope is engaged with the teeth of the pinion gear. However, since there are provided the two chambers, the engine starting apparatus undesirably becomes complicated in construction and large in size. Thus, there is a room for improvement to provide a simply arranged and small-sized engine starting apparatus.

Moreover, the applicants of the present invention have proposed an engine starting apparatus having a starter motor and a recoil starter in Japanese Patent Laid-Open Publication No. HEI-3-258969.

The proposed engine starting apparatus includes a first one-way clutch provided at one part of a series of decelerating gears for decelerating rotation of the starter motor, and a pulley disposed between a final gear of the series of decelerating gears and a crankshaft of an engine so that the rotation of the starter motor is transmitted to the crankshaft through centrifugal ratchets provided at the pulley and the series of decelerating gears. On a supporting shaft of the final gear, there is provided a clutch plate meshed with the centrifugal ratchets. A release cam is provided outwardly of the clutch plate. A second one-way clutch is forced into an inner diameter portion of the release cam.

In the engine starting apparatus as described above, when the clutch plate is rotated in such a direction as to start the engine, the clutch plate and the centrifugal ratchets start to rotate in mesh with each other. On the other hand, when the clutch plate is rotated in a direction opposite to the former due to an overload on the engine under operation, the clutch plate is forcibly disengaged from the centrifugal ratchets by the release cam prevented from rotating in the opposite direction by the second one-way clutch.

However, since each of the two one-way clutches uses a well-known needle roller one-way clutch, they must be extremely precise in dimension. Further, needle rollers are partially worn by long-term use thereof to thereby make the one-way clutches inoperative often. Furthermore, since such a needle roller one-way clutch is expensive, there has been desired an improvement in the one-way clutch.

SUMMARY OF THE INVENTION

A first object of the present invention is to provide an engine starting apparatus which allows attachment to an engine in free directions and which uniformly takes in external air sufficient to cool the engine.

A second object of the present invention is to provide an engine starting apparatus which can be efficiently attached to a side of the engine with a small number of bolts without presenting an obstruction to an operation of pulling a starting rope.

A third object of the present invention is to provide an engine starting apparatus which is simply arranged and prevents the starting rope from being dirtied and being engaged with teeth of a gear.

A fourth object of the present invention is to provide an engine starting apparatus including thin and compact one-way clutches which need not be extremely precise in dimension and which provide the least deterioration thereof even when used for a long term.

According to an aspect of the present invention, there is provided an engine starting apparatus which includes a case having a cup-shaped outer case and a substantially sheet-shaped case cover, the outer case and the case cover jointly defining a space, and a self-starter mechanism accommodated within the space, in which an engine body is positioned outside the case cover, the engine starting apparatus comprising: a motor mounting seat for mounting a starter motor thereon, the motor mounting seat being formed in the outer case; a large number of first louvers disposed at substantially the same position as the motor mounting seat and extending from the case cover toward the engine body; and a large number of second louvers formed on a wall portion formed on the outer case, the wall portion extending from the outer case toward the engine body, wherein the entire periphery of the case takes in external air by means of the first and second louvers.

In the engine starting apparatus thus arranged, the motor mounting seat for mounting the starter motor thereon is formed in the outer case. By thus attaching the starter motor to the motor mounting seat, the starter motor faces counter to the engine body and hence the starter motor does not protrude toward the engine body. Since the starter motor does not protrude toward the engine body in the manner as discussed above, the engine body and the starter motor do not bump against each other irrespective of configuration and size of an engine with the result that a position where the starter motor is mounted can be freely set around a crankshaft.

Further, a large number of first louvers is formed on a part of the case cover in the direction where the motor mounting seat is provided while a large number of second louvers is formed on the wall portion extending from the outer case toward the engine body. It thus becomes possible to take in external air by means of the first louvers formed on the case cover where the motor mounting seat is provided and to take in external air by means of the second louvers of the outer case where the motor mounting seat are not provided, thereby effecting intake of external air throughout the entire periphery of the case jointly formed by the outer case and the case cover. Therefore, it becomes possible to not only take in external air sufficiently by means of the case but also cool the engine body without making the flow of the external air non-uniform.

Preferably, three bolt apertures for attaching the case to the engine body are formed at every 120 degrees on the same pitch circle of the case, whereby the direction of the engine starting apparatus can be varied every 120 degrees on the engine body to take in external air uniformly.

Desirably, the case further accommodates therein a recoil starter mechanism, with one of the three bolt apertures designated as a first bolt aperture and the other bolt apertures designated as second and third apertures, respectively, the recoil starter mechanism having a starting rope pulling port disposed adjacent to the first bolt aperture, the starter motor of the self-starter mechanism being disposed between the first bolt aperture and the third bolt aperture when the starting rope pulling port is positioned between the first bolt aperture and the second bolt aperture, the starter motor being disposed between the first bolt aperture and the second bolt aperture when the starting rope pulling port is positioned between the first bolt aperture and the third bolt aperture.

Provision of the bolt apertures formed on the case at every 120 degrees makes it possible to efficiently attach the engine starting apparatus to the engine side with a small number of bolts. Further, the direction of the engine starting apparatus mounted on the engine can be varied at every 120 degrees by rotating the engine starting apparatus on the engine through 120 degrees, whereby the direction of the starting rope pulling port can be freely selected from three directions depending on the configuration and surroundings of the engine. It therefore becomes possible to select a position of the starting rope pulling port such that a starting rope can be pulled easily.

Also, for example, when the starting rope pulling port is disposed between the first bolt aperture and the second bolt aperture, the starter motor is positioned between the first bolt aperture and the third bolt aperture, thereby achieving separation of the starting rope pulling port from the starter motor with the result that the starter motor does not present an obstruction to an operation of pulling out the rope even when the direction of the starting rope pulling port is varied on the engine body.

In a preferred form, the case further accommodates therein a recoil starter mechanism. Also, a final gear forming one part of the self-starter mechanism and a rope winding pulley of the recoil starter mechanism are disposed closely to and coaxially with each other. The rope winding pulley is surrounded by a peripheral wall portion extending from an inner surface of the case. The final gear includes a flange formed on a side end of teeth thereof facing to the rope winding pulley. The peripheral wall portion extends so that an end thereof is disposed closely to the flange.

In other words, in the present invention, a gap between the flange and an end of the peripheral wall portion for surrounding the rope winding pulley of the recoil starter mechanism is very small to thereby provide a so-called labyrinthine seal structure jointly defined by the peripheral wall portion and the flange. Such a seal structure prevents a lubricating oil (including grease) clung to the final gear from being scattered to the rope winding pulley. Further, it is unlikely that the loosened starting rope comes out of the gap. Thus, in the present invention, even when the rope winding pulley is disposed closely to and coaxially with the final gear, the starting rope is prevented from being dirtied by the lubricating oil and being engaged with the teeth of the final gear.

It is preferred that an engine starting apparatus further comprises a first one-way clutch provided at one part of a series of gears for transmitting rotation of the starter motor to a crankshaft, and a second one-way clutch provided in a transmission mechanism for transmitting rotation of the rope winding pulley of the recoil starter mechanism to the crankshaft. The first one-way clutch comprises a second small gear having step portions on an inner peripheral surface thereof, and a first large gear having ratchets urged to mesh with the step portions only when the first large gear is rotated in such a direction as to start an engine. Such a first one-way clutch may be provided radially internally of the first large gear operated simultaneously with a first small gear serving as a decelerating gear attached to an output shaft of the starter motor.

Preferably, the second one-way clutch includes a cylinder portion having axially protruding projections on a back side of the rope winding pulley of the recoil starter mechanism and groove portions formed on an outer periphery of the rope winding pulley, and a second large gear having a release plate with elongated apertures into which the projections are fitted and ratchets urged to mesh with the groove portions only when the rope winding pulley is rotated in such a direction as to start an engine.

With the thus arranged first and second one-way clutches of the present invention, each one-way clutch needs not be extremely precise in dimension and provides the least deterioration even when used for a long term. Moreover, the number of parts are decreased to thereby provide a cheap engine starting apparatus. Further, the clutch can be made thin to thereby provide a compact starting apparatus.

BRIEF DESCRIPTION OF THE DRAWINGS

Certain preferred embodiments of the present invention will be hereinafter described in detail, by way of example only, with reference to the accompanying drawings, in which:

FIG. 8 is a cross-sectional view of the engine with the engine starting apparatus of the present invention attached thereto, showing flow of external air taken in;

DETAILED DESCRIPTION OF THE PREFERRED EMBODIMENT

The following description is merely exemplary in nature and is in no way intended to limit the invention or its application or uses.

Figure 1:
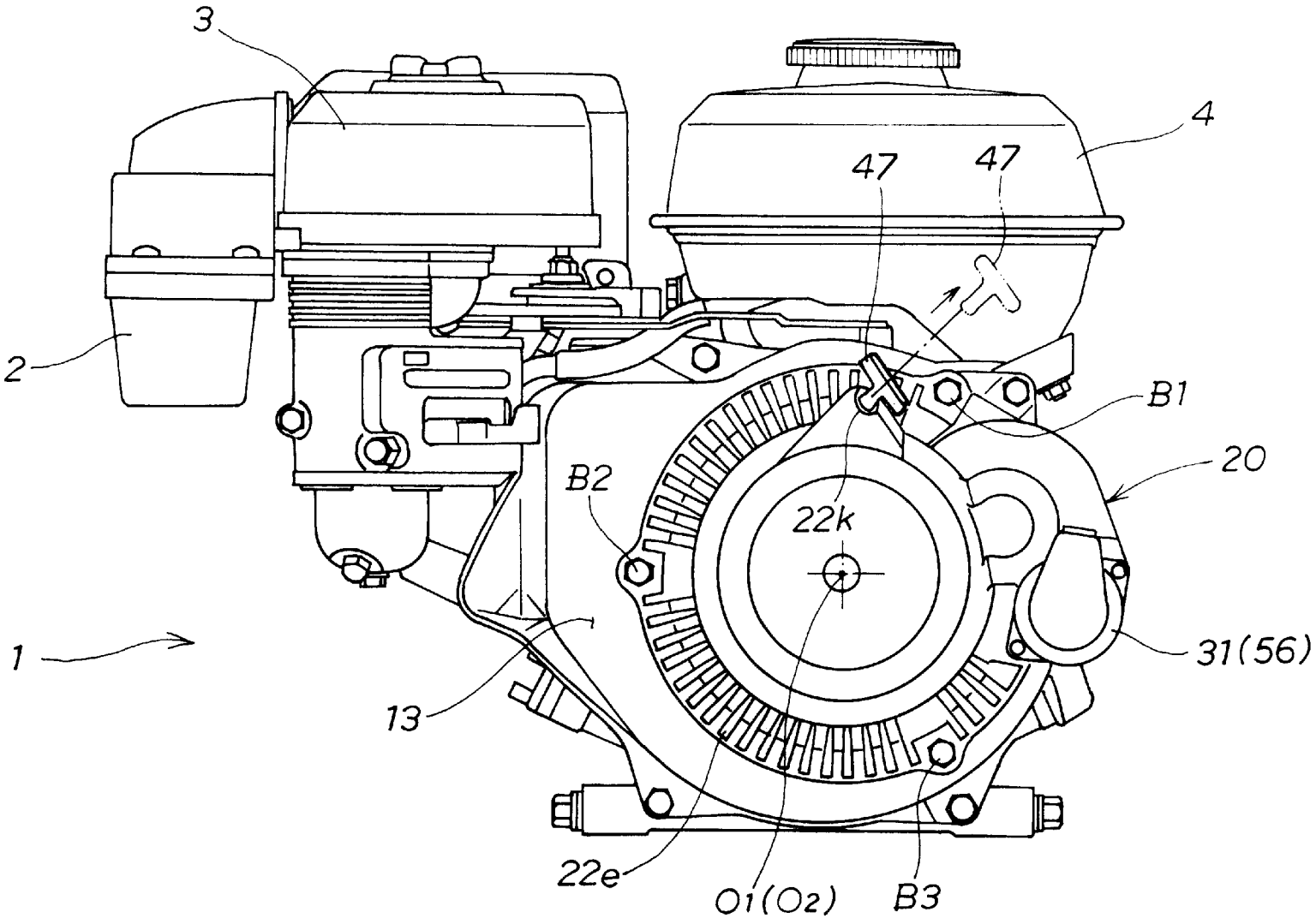
FIG. 1 is a front elevational view of an engine with an engine starting apparatus of the present invention attached thereto.

FIGS. 1 through 8 show an engine starting apparatus of the present invention. Referring to FIG. 1, an engine body 1*b* (see FIG. 8) is positioned behind an engine starting apparatus 20. With a crankshaft center $O_1$ positioned centrally of the engine apparatus 20, the engine starting apparatus 20 is mounted on a side of an engine 1 by three mounting bolts B1, B2, B3.

Figure 8:
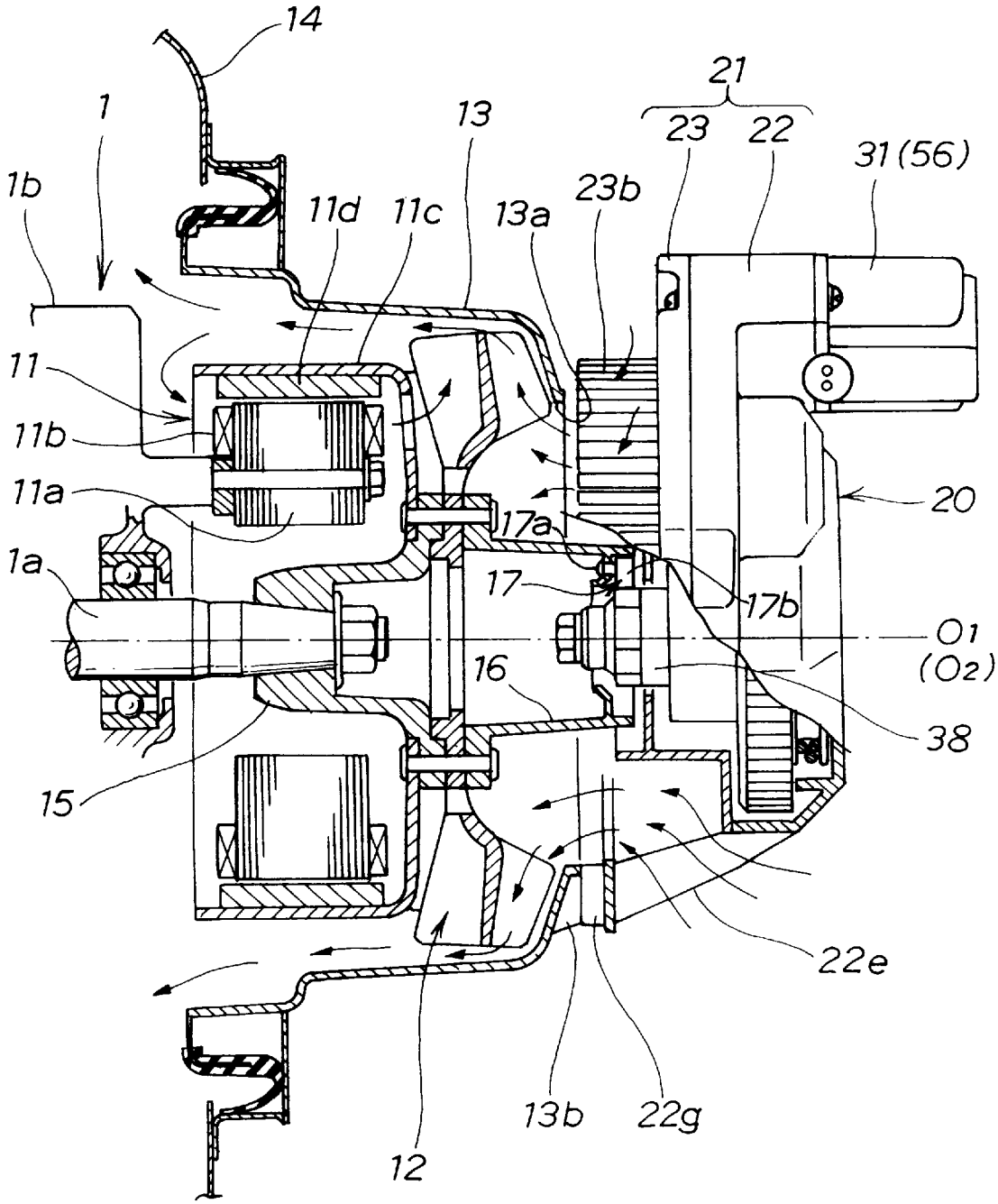

The engine 1 shown in FIG. 8 comprises a horizontally arranged four-cycle gasoline engine with a crankshaft 1*a* extending toward the engine starting apparatus 20. As shown in FIG. 1, reference numerals 2, 3, 4 denote an air cleaner, a carburetor and a fuel tank, respectively.

Figure 2:
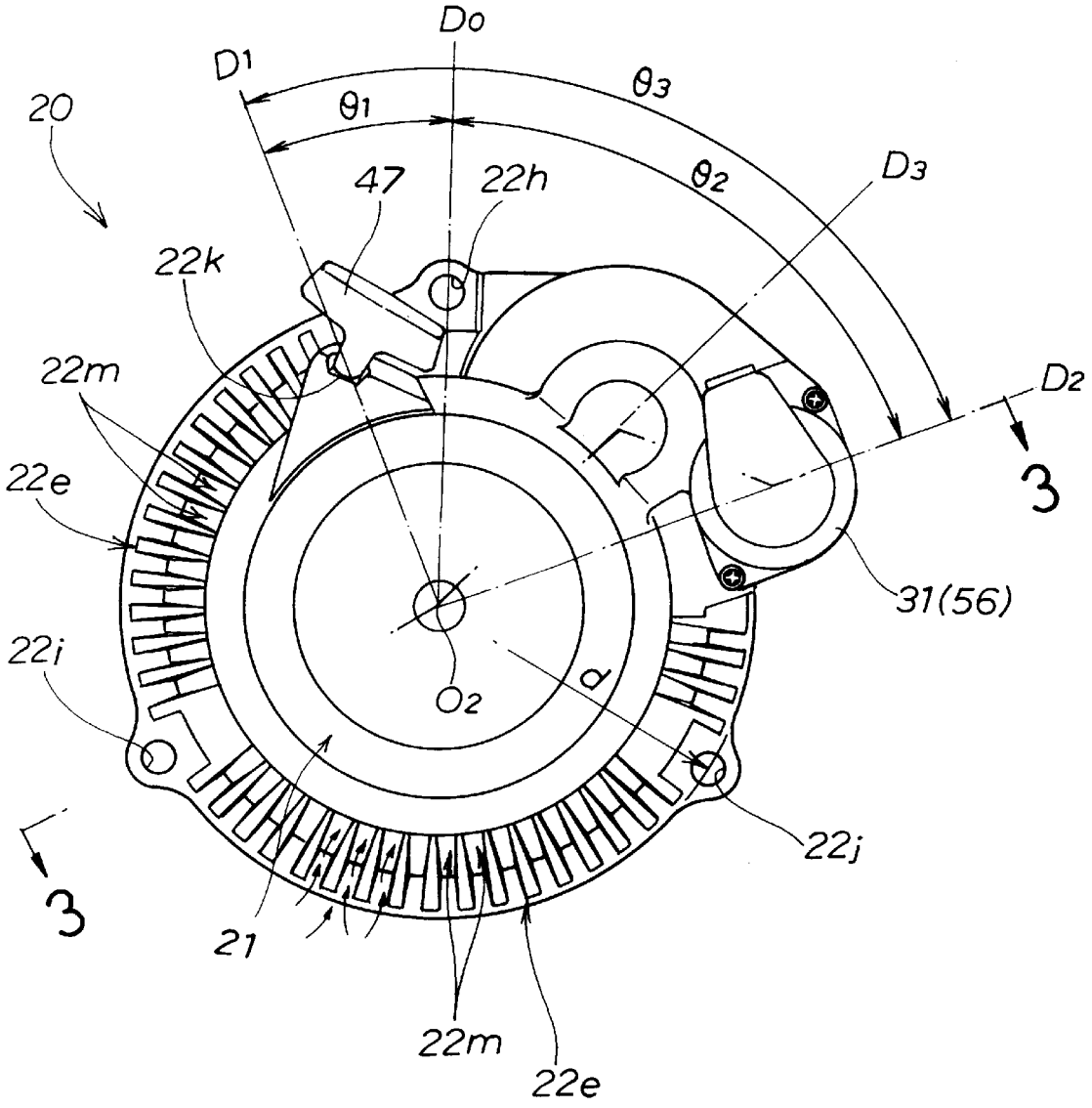
FIG. 2 is a front elevational view of the engine starting apparatus shown in FIG. 1.

As shown in FIG. 2, a case 21 of the engine starting apparatus 20 includes three bolt apertures 22*h*, 22*i*, 22*j* for passing the mounting bolts B1, B2, B3 therethrough, which are formed at every 120 degrees on a pitch circle d having an output shaft center $O_2$ as its center The bolt aperture positioned at the uppermost portion of the pitch circle d is designated as a first bolt aperture 22*h*. The other bolt apertures are designated as a second bolt aperture 22*i* and a third bolt aperture 22*j*, respectively, in counterclockwise order.

A recoil starter mechanism 40 (see FIG. 3) includes a starting rope pulling port 22*k* disposed proximate to the first bolt aperture 22*h*. In the embodiment of the present invention, when the starting rope pulling port 22*k* is disposed between the first and second bolt apertures 22*h*, 22*i*, a starter motor 31 of a self-starter motor mechanism 30 (see FIG. 3) is disposed between the first and third bolt apertures 22*h*, 22*j*.

With individual directions of the first bolt aperture 22*h*, the starting rope pulling port 22*k*, and the starter motor 31 designated by reference numerals $D_0$, $D_1$, $D_2$, respectively, relations between the directions $D_0$, $D_1$, $D_2$ will be described below:

(1) the direction $D_1$ of the starting rope pulling port 22*k* is inclined $\theta_1$ (about 20 degrees) degrees away from the direction $D_0$ of the first bolt aperture 22*h* toward a side of the second aperture 22*i;*

(2) the direction $D_2$ of the starter motor 31 is inclined $\theta_2$ (about 70 degrees) degree away from the direction $D_0$ of the first bolt aperture 22*h* toward a side of the third bolt aperture 22*j:*

(3) an angle $\theta_2$ between the direction $D_1$ of the starting rope pulling port 22*k* and the direction $D_2$ of the starter motor 31 is a sum of $\theta_1$ and $\theta_2$ ($\theta_1+\theta_2$) to thereby make about 90 degrees.

Figure 3:
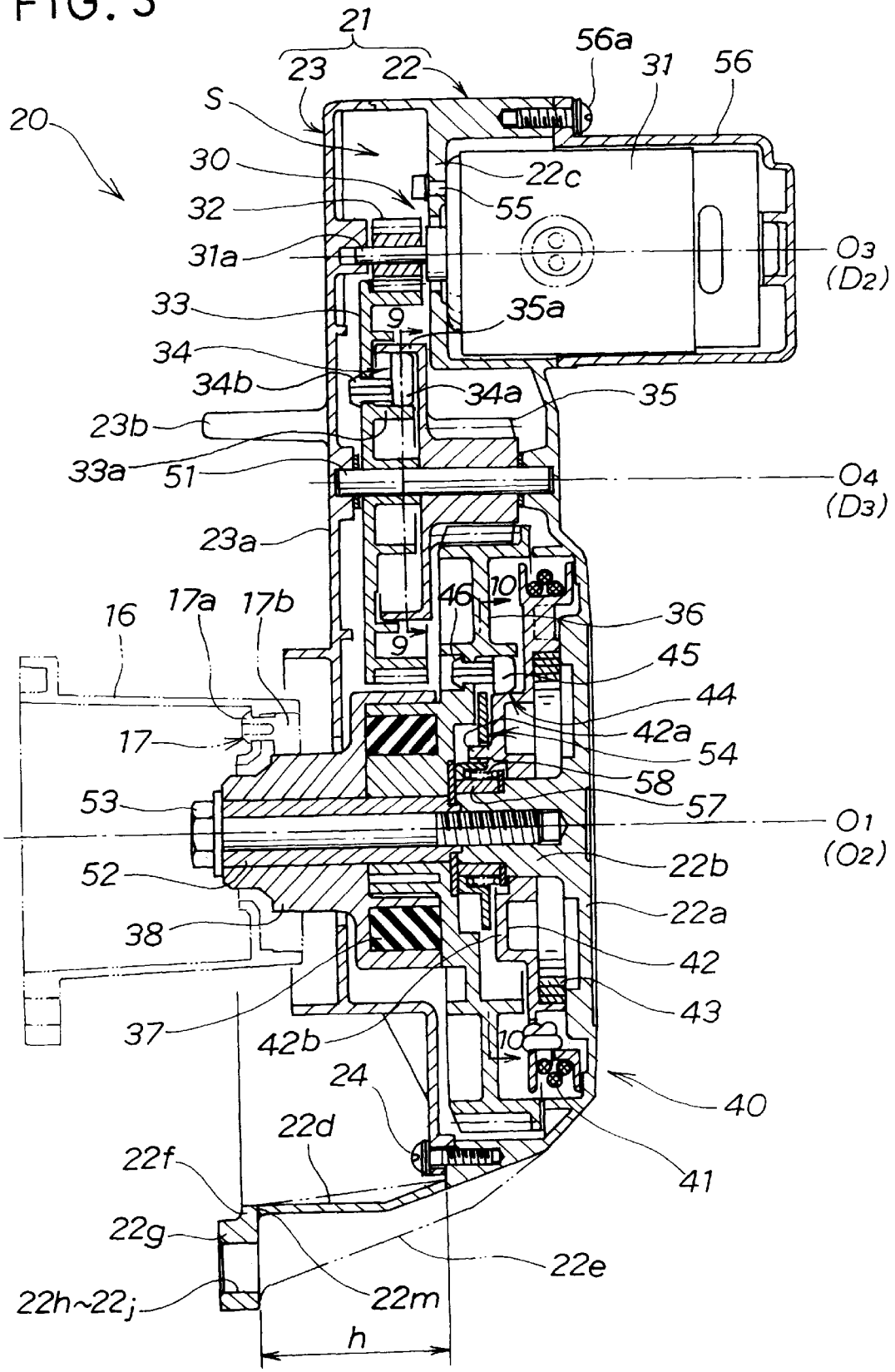
FIG. 3 is an enlarged cross-sectional view taken along line 3—3 of FIG. 2.

Turning to FIG. 3, the engine starting apparatus 20 includes the case 21, the self-starter mechanism 30 and the recoil starter mechanism 40 accommodated in a space S within the case 21. The case 21 is formed by joining together a cup-shaped outer case 22 and a substantially sheet-shaped case cover 23 by means of a plurality of screws 24. The space S within the case 21 is defined jointly by the outer case 22 and the case cover 23.

The self-starter mechanism 30 is a mechanism in which the starter motor 31 is rotated to rotate a crankshaft. Also, the recoil starter mechanism 40 is a rope starting mechanism in which the crankshaft is rotated by unwinding a starting rope 41 to be automatically wound in the case 21.

The self-starter mechanism 30 comprises the starter motor 31, a first small gear 32 mounted on an output shaft 31*a* of the starter motor 31, a first large gear 33 meshing with the first small gear 32, a second small gear 35 connected to the first large gear 33 through a first one-way clutch 34, a second large gear 36 serving as a final gear of the self-starter mechanism 30 and meshing with the second small gear 35, and an output shaft 38 connected to the second large gear 36 through a rubber damper 37.

The recoil starter mechanism 40 comprises a rope winding pulley 42 on which the starting rope 41 is wound, a rope return spring 43 for causing the rope winding pulley 42 to automatically wind the starting rope 41 thereon, the second large gear 36 connected to the rope winding pulley 42 through a second one-way clutch 44, and the output shaft 38 connected to the second large gear 36 through the rubber damper 37.

The second large gear 36 and the output shaft 38 thus arranged serve as components of both the self-starter mechanism 30 and the recoil starter mechanism 40.

The first large gear 33 and the second small gear 35 are rotatably mounted on a first intermediate shaft 51. The second large gear 36 serving as the final gear and the substantially cylindrical output shaft 38 are rotatably mounted on a second intermediate shaft 52. The rope winding pulley 42 is rotatably mounted on a supporting shaft portion 22*b* formed in the outer case 22.

The second intermediate shaft 52 is a sleeve-shaped shaft having the output shaft center $O_2$ as a center thereof and attached to the outer case 22 through a bolt 53. The supporting shaft portion 22*b* has the output shaft center $O_2$ as a center thereof and protrudes inwardly from an inner bottom wall 22*a* of the outer case 22.

The one-way clutch 34 is a clutch which allows a power transmission from the first large gear 33 to the second small gear 35 and which disallows a counter power transmission from the second small gear 35 to the first large gear 33. Similarly, the second one-way clutch 44 is a clutch which allows a power transmission from the rope winding pulley 42 to the second large gear 36 and which disallows a counter power transmission from the second large gear 36 to the rope winding pulley 42. The rubber damper 37 has a function to attenuate vibration and pulsation between the second large gear 36 and the output shaft 38. As shown in FIG. 3, reference numeral 54 denotes a release plate for preventing the rope winding pulley 42 from rotating in such a direction as to wind the starting rope 41 thereon when the engine is out of operation.

In the inner bottom wall 22*a* of the outer case 22, there is formed a motor mounting seat 22*c*. The starter motor 31 is attached to the motor mounting seat 22*c* through a bolt 55. A rear portion of the starter motor 31 protrudes rearwardly (rightward in FIG. 3) from the outer case 22 and the protruding portion of the starter motor 31 is covered with a motor cover 56. The motor cover 56 is attached to the outer case 22 by a cover fastening screw 56*a*.

Further, the outer case 22 includes a wall portion 22*d* extending toward the engine side (leftward in FIG. 3). On the wall portion 22*d*, there are formed a large number of second louvers 22*e* shown in a phantom line. A flange 22*f* is formed on an end of the wall portion 22*d*. On the flange 22*f*, three mounting leg portions 22*g* (see FIG. 5) are formed. First, second, and third bolt apertures 22*h*, 22*i*, 22*j* are formed in the mounting leg portions 22*g*. Designated by reference numeral 22*m* are second external air intake ports defined between the second louvers 22*e*. Reference character h represents a height of the second external air intake port 22*m*.

The case cover 23 includes a large number of first louvers 23*b* (see FIG. 4) extending from an outer surface 23*a* toward the engine side (leftward in FIG. 3) with the output shaft 38 protruding from the outer surface 23*a*. The first louvers 23*b* extend to such a degree that they may not protrude from an end surface of each mounting leg portion 22*g*.

As can be seen from the foregoing description, the present embodiment is characterized by the first louvers 23*b* extending from the outer surface 23*a* of the case cover 23 toward the engine side, the wall portion 22*d* of the outer case 22 extending toward the engine side, the second louvers formed on the wall portion 22*d*, and the mounting leg portions 22*g* formed on the end of the wall portion 22*d*.

Arrangement of the first and second louvers 23*b*, 22*e* will be set forth later. Reference numerals $O_3$, $O_4$ denote a starter motor center (and a motor mounting seat center) and a first intermediate shaft center, respectively. A direction $D_3$ of the first intermediate shaft center $O_4$ is provided between the direction $D_0$ of the first bolt aperture 22*h* and the direction $D_2$ of the starter motor 31 as shown in FIG. 2.

In the engine starting apparatus 20 of the present embodiment, the self-starter mechanism 30 and the recoil starter mechanism 40 are accommodated within the case 21 in common. The second large gear 36 as the final gear of the self-starter mechanism 30 and the rope winding pulley 42 are disposed around the output shaft center $O_2$ in coaxial relation to each other.

Figure 4:
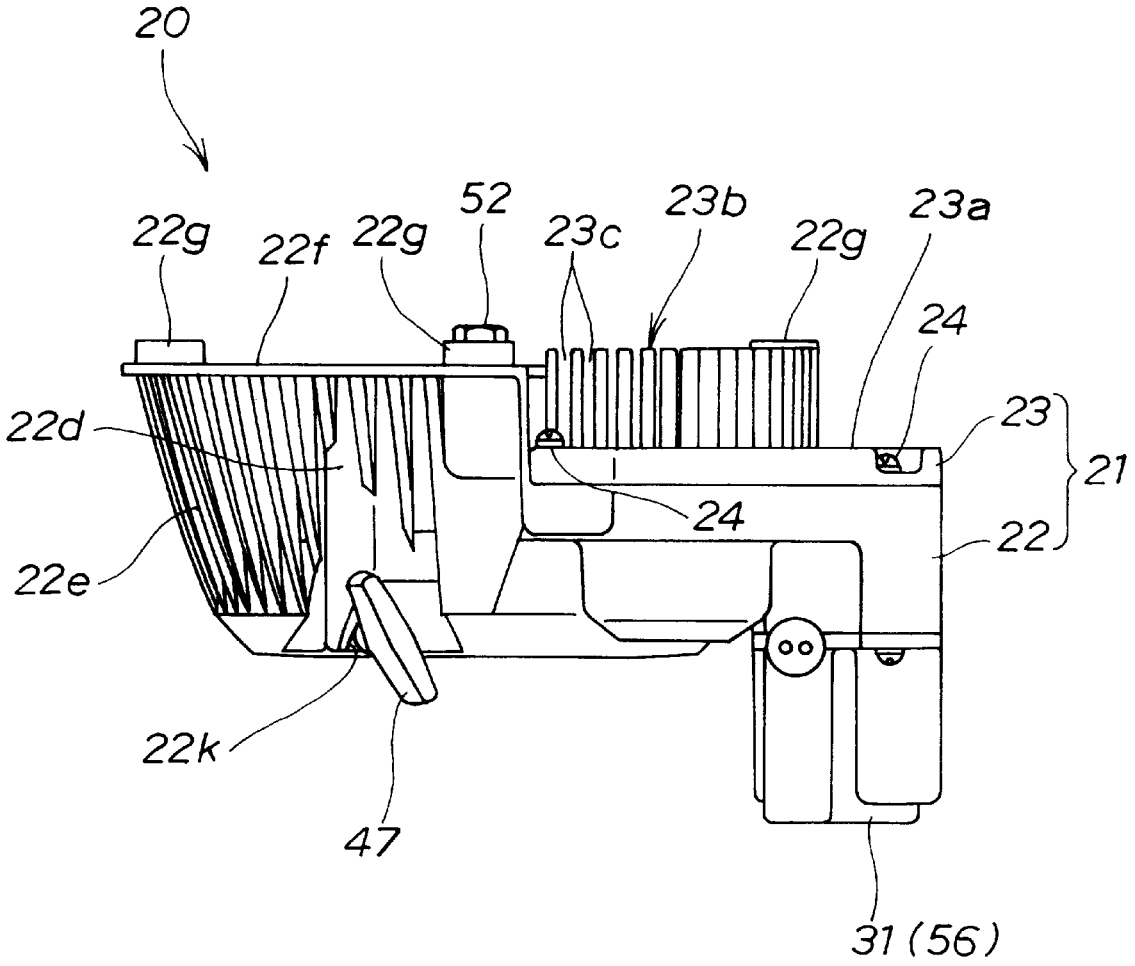
FIG. 4 is a top plan view of the engine starting apparatus shown in FIG. 2.

Referring to FIG. 4, the first louvers 23*b* extend from the outer surface 23*a* of the case cover 23 toward the engine 1 (see FIG. 8). The second louvers 22*e* are formed on the wall portion 22*d* of the outer case 22. The starting rope pulling port 22*k* is formed in an outer surface of the outer case 22.

A lever 47 provided for pulling out the starting rope 41 is mounted on an end of the starting rope 41.

Figure 5:
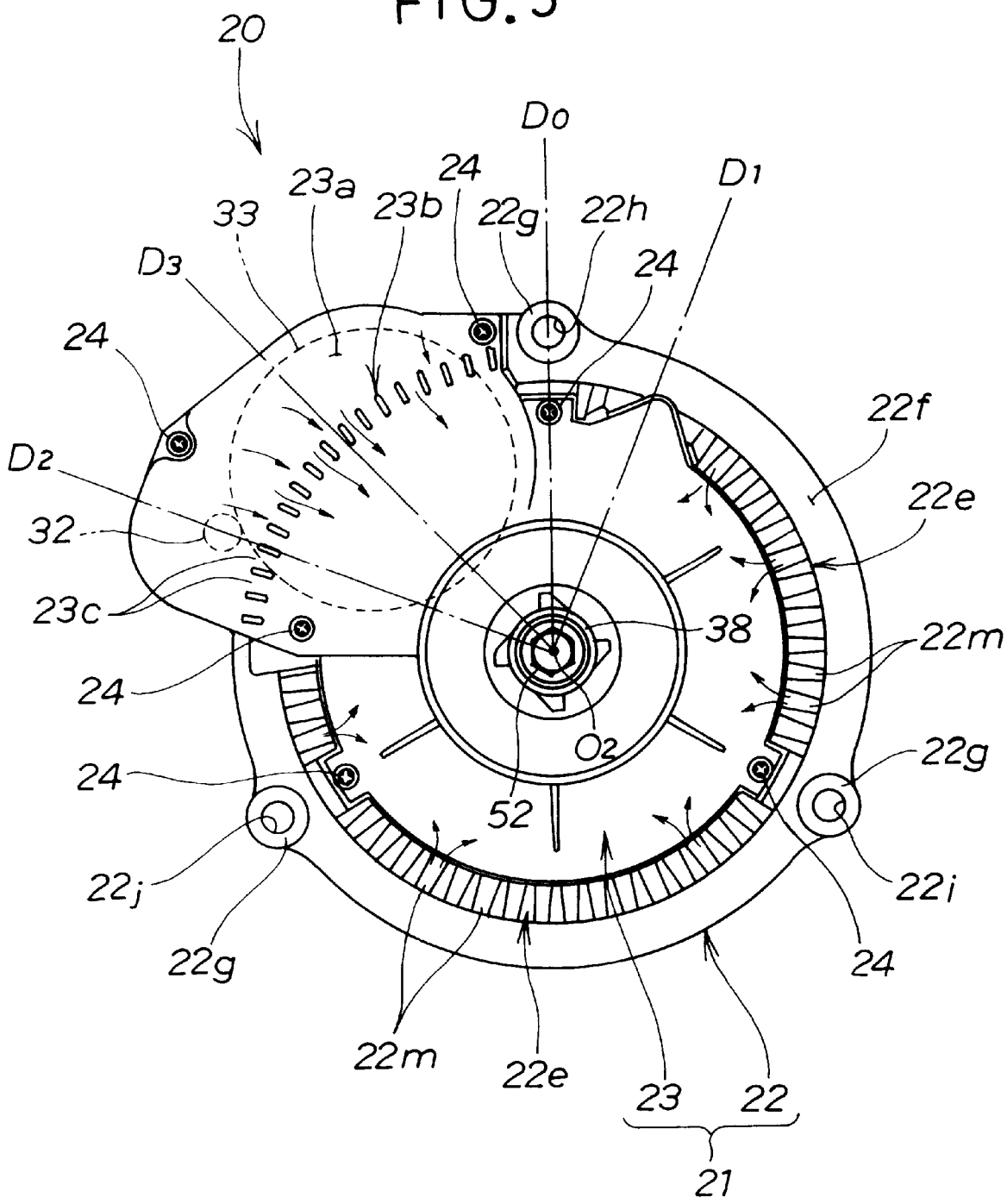
FIG. 5 is a rear elevational view of the engine starting apparatus shown in FIG. 2.

Reference is made to FIG. 5. On the case cover 23, the first louvers 23*b* are formed in the direction $D_2$ of the starter motor 31 (see FIG. 3), that is, in substantially the same direction as the motor mounting seat 22*c* (see FIG. 3). The second louvers 22*e* are formed on the outer case 22 where the first louvers 23*b* are not formed.

More specifically, the first and second louvers 23*b*, 22*e* are annularly arranged on a circle having the output shaft center $\theta_2$ as its center The first louvers 23*b* are arranged on a part of the circle where the first small gear 32 and the first large gear 33 are disposed (in the direction $D_2$ of the starter motor 31 and the motor mounting seat 22*c* and in the direction $D_3$ of the first intermediate shaft 51). The second louvers 22*e* are arranged on the remaining part of the circle where the first louvers 23*b* are not disposed. Consequently, the first external air intake ports 23*c* defined between the first louvers 23*b*, and the second external air intake ports 22*m* defined between the second louvers 22*e* are formed throughout the entire periphery of the case 21. Therefore, provision of the first and second louvers 23*b*, 22*e* makes it possible to take in external air throughout the entire periphery of the case 21.

Each pitch or cross-sectional area of the first and second external air intake ports 23*c*, 22*m* is determined such that intake of external air throughout the entire periphery of the case 21 is made uniform by providing the first and second louvers 23*b*, 22*e*.

Figure 6:
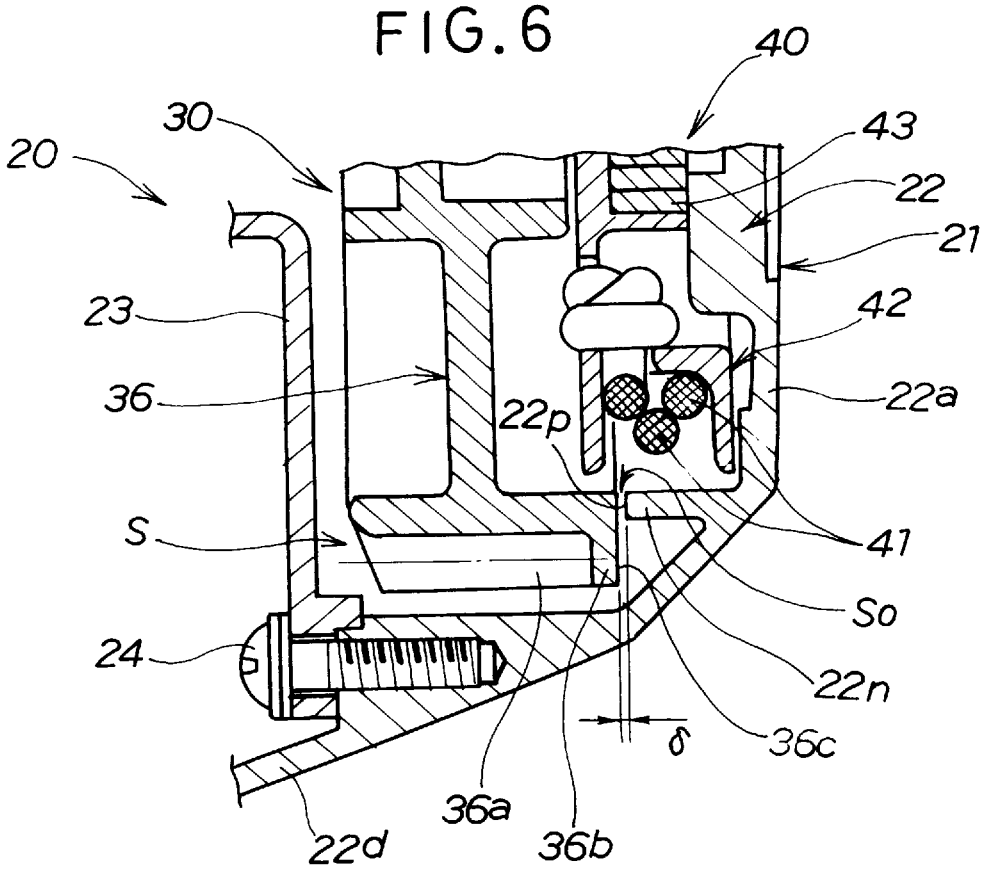
FIG. 6 an enlarged cross-sectional view illustrating a relation between a final gear and a rope winding pulley of FIG. 3

FIG. 6 shows a relation between the second large gear 36 serving as the final gear and the rope winding pulley 42.

As shown in FIG. 6, the outer case 22 includes a cylindrical peripheral wall portion 22*n* extending from an inner surface thereof, i.e., the inner bottom wall 22*a* toward the case cover 23. The rope winding pulley 42 is surrounded by the inner bottom wall 22*a* and the peripheral wall portion 22*n*. However, because the second large gear 36 is positioned in confronting relation to a surface of the rope winding pulley 42, it becomes unnecessary to surround the surface with the inner bottom wall 22*a* and the peripheral wall portion 22*n*.

Throughout the overall periphery of the second large gear 36, there is provided a flange 36*b* formed at a side of teeth 36*a* thereof proximate to the rope winding pulley 42 adjacent to the second large gear 36.

An end 22*p* of the peripheral wall portion 22*n* extends such that it is disposed adjacent to the flange 36*b*. A gap $S_0$ between the end 22*p* and the flange 36*b* is very small in width.

A width $\delta$ of the gap $S_0$ is set such that the least lubricating oil (including grease) clung to the teeth 36*a* of the second large gear 36 passes therethrough and the starting rope 41 can not pass therethrough.

Figure 7:
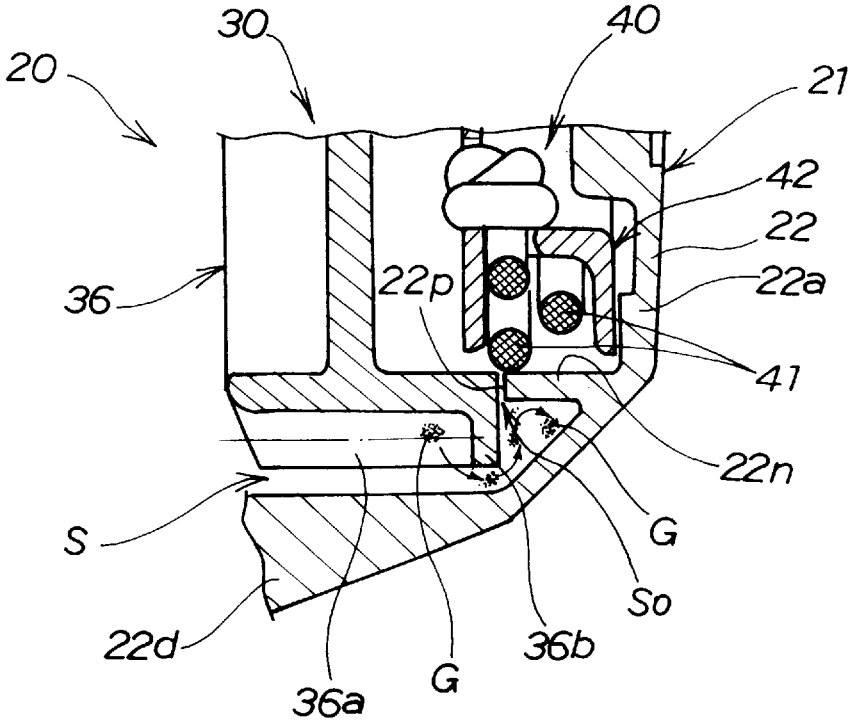
FIG. 7 is an enlarged cross-sectional view illustrating a relation between a flange of the final gear and a peripheral wall portion of FIG. 3.

FIG. 7 illustrates how the flange 36*b* of the second large gear 36 serving as the final gear and the peripheral wall portion 22*n* formed on the outer case 22 are operated.

Referring to FIG. 7, a labyrinthine seal structure is formed by the peripheral wall portion 22*n*, the flange 36*b* and the gap $S_0$. The labyrinthine seal structure prevents lubricating oil G clung to the teeth 36*a* of the second large gear 36 from being scattered to the rope winding pulley 42. It is therefore unlikely that the starting rope 41 is dirtied by the lubricating oil G.

As illustrated in FIG. 6, the starting rope 41 does not come out of the very small gap $S_0$ even when loosened. It will be appreciated that the starting rope 41 is not engaged with the teeth 36*a* of the second large gear 36.

Thus, within the case 21, even when the rope winding pulley 42 is disposed closely to and coaxially with the second large gear 36, the starting rope 41 is not made dirty by the lubricating oil G and is not engaged with the teeth 36*a* of the second large gear 36 to thereby provide the small-sized engine starting apparatus 20 thus simply arranged.

FIG. 8 shows the engine starting apparatus 20 with the crankshaft center $O_1$ of the engine 1 coincided with the output shaft center $O_2$ of the engine starting apparatus 20.

The engine 1 is a generator-driving engine for driving a generator 11 serving as, for example, a load and includes the generator 11 and an air cooling fan 12 provided on one side of the crankshaft 1*a*, a fan cover 13 for surrounding the generator 11 and the air cooling fan 12, and a shroud (an air cooling duct) 14 joined to the fan cover 13 for surrounding the engine body 1*b*.

The generator 11 comprises a core 11*a* and a coil 11*b* mounted on the engine body 1*b*, a cup-shaped outer rotor 11*c* attached to the crankshaft 1*a* by means of a boss 15, and a magnet lid fixedly attached to the outer rotor 11*c*.

The crankshaft 1*a* is connected by the boss 15 to the air cooling fan 13 (a fan rotor) and a coupling 16 connected to the output 38. The generator 11, the cooling fan 12 (the fan rotor) and the coupling 16 are disposed around the crankshaft center $O_1$ in concentric relation to each other.

In the fan cover 13, there is formed an intake port 13*a* having the crankshaft center $O_1$ as a center thereof. Three mounting seats 13*b* (only one shown in FIG. 8) are provided around the intake port 13*a*. Each mounting seat 13*b* is bolted to the mounting leg portion 22*g* of the engine starting apparatus 20. The wall portion 22*d* of the outer case 22 of the engine starting apparatus 20 is substantially equal in diameter to the intake port 13*a*.

An end of the cup-shaped coupling 16 protrudes from the intake port 13*a* and is connected to the output shaft 38 of the engine starting apparatus 20 through a third one-way clutch 17. The third one-way clutch 17 allows power transmission from the output shaft 38 to the coupling 16 and disallows power transmission from the coupling 16 to the output shaft 38.

Now, operation of the engine starting apparatus 20 as previously described will be explained with reference to FIG. 2.

When the lever 47 is pulled to unwind the staring rope 41 shown in FIG. 3, a relatively large pulling force acts on the starting rope pulling port 22*k*. Accordingly, the starting rope pulling port 22*k* is disposed in the proximity of the first bolt aperture 22*h*. In other words, the direction $D_1$ of the starting rope pulling port 22*k* is inclined $\theta_1$ (about 20 degrees) degree away from the direction $D_0$ of the first bolt aperture 22*h*. The case 21 is attached to the engine side by inserting the mounting bolt B1 (see FIG. 1) through the first bolt aperture 22*h*.

A rope-pulling force is applied to the engine side through the mounting bolt B1 proximate to the starting rope pulling port 22*k*. Since a distance between the starting rope pulling port 22*k* and the mounting bolt B1 is small, an excessive force does not act on the case 21. This makes it unnecessary to increase rigidity of the case 21, thereby making the case 21 thin and small.

Further, by providing the three bolt apertures 22*h*, 22*i*, 22*j* formed on the pitch circle d at every 120 degrees, it becomes possible to efficiently attach the engine starting apparatus 20 to the engine 1 with a small number of bolts B1, B2, B3. Furthermore, by rotating the case 21 on the engine 1, the direction of the engine starting apparatus 20 mounted on the engine 1 can be freely varied at every 120 degrees. Thus, it will be appreciated that the direction of the starting rope pulling port 22*k* is freely selected from the three directions in accordance with configuration and surroundings of the engine, thereby facilitating the operation of pulling out the starting rope.

Moreover, the starting rope pulling port 22*k* is disposed between the first bolt aperture 22*h* and the second bolt aperture 22*i* while the starter motor 31 is disposed between the first aperture 22*h* and the third bolt aperture 22*j*. Stated otherwise, the angle $\theta_3$ between the direction $D_1$ and the direction $D_2$ is 90 degrees, where the $D_1$, $D_2$ represent directions of the starting rope pulling port 22*k* and the starter motor 31, respectively. The starting rope pulling port 22*k* can be spaced from the starter motor 31 in the manner as previously described. Thus, even when the direction of the starting rope pulling port 22*k* is varied on the engine, the starter motor 31 does not present an obstruction to the operation of pulling out the rope.

Also, when the starting rope pulling port 22*k* is disposed between the first bolt aperture 22*h* and the third bolt aperture 22*j*, the starter motor 31 may be disposed between the first bolt aperture 22*h* and the second bolt aperture 22*i*.

Next, operations of the self-starter mechanism 30 and the recoil starter mechanism 40 will be described below.

Turning to FIG. 3, upon starting the starter 31, power of the starter motor 31 is transmitted through the first small gear 32, the first large gear 33, the first one-way clutch 34, the second small gear 35, the second large gear 36, the rubber damper 37, the output shaft 38, the third one-way clutch 17, the coupling 16, the cooling fan 12 shown in FIG. 8, the boss 15 to the crankshaft 1*a*, thereby rotating the crankshaft 1*a*.

When the starting rope 41 is unwound by pulling the lever 47 (see FIG. 1), the pulling force is transmitted through the rope winding pulley 42, the second one-way clutch 44, the second large gear 36, the rubber damper 37, the output shaft 38, the third one-way clutch 17, the coupling 16, the cooling fan 12 shown in FIG. 8, the boss 15 to the crankshaft 1*a*, thereby rotating the crankshaft 1*a*.

Next, a manner of cooling the engine with external air will be described with reference to FIG. 8.

Referring to FIG. 8, the crankshaft 1*a* is rotated to rotate the outer rotor 11*c* and the air cooling fan 12. Upon rotation of the air cooling fan 12, external air is taken into the intake port 13*a* via the first external air intake ports 23*c* and the second external air intake ports 22*m* and flows through the fan cover 13 into the shroud 14 to thereby cool the generator 11 and the engine body 1*b*.

As shown in FIGS. 3 and 5, in the direction D2 of the starter motor 31 and the motor mounting seat 22*c*, external air can be taken into the fan cover 13 through the first external air intake ports 23*c*. Similarly, in directions where the starter motor 31 and the motor mounting seat 22*c* are not disposed, external air can be taken into the fan cover 13 through the second external air intake ports 22*m*. As a result, provision of the first and second louvers 23*b*, 22*e* makes it possible to take in external air throughout the entire periphery of the case 21. By virtue of such an intake of external air throughout the entire periphery of the case 21, the external air flows in the fan cover 13 and the shroud 14 uniformly. Further, the intake of external air throughout the entire periphery of the case makes it possible to provide sufficient total cross-sectional area of the first external air intake ports 23*c* and the second external air intake ports 22*m* for taking in external air. Consequently, performance for cooling the engine with external air can be improved.

Flow of external air through the first external air intake ports 23*c* becomes unequal to the same through the second external air intake ports 22*m* by surroundings of the engine. The f low of the external air in the fan cover 13 and the shroud 14 is thus made non-uniform. In this regard, as shown in FIG. 2, the case 21 includes the three bolt apertures 22*h*, 22*i*, 22*j* for mounting the case 21 to the engine side, which are formed on the pitch circle d at every 120 degrees. Since the engine starting apparatus 20 can be rotated at every 120 degrees until external air flows in the fan cover 13 and the shroud 14 uniformly, optimal attachment of the engine starting apparatus 20 to the engine is effected to thereby make flow of the external air less non-uniform.

Next, description will be made as to constructions of the first one-way clutch 34 and the second one-way clutch 44 in relation to FIG. 3 and FIGS. 9A through 10B.

As shown in FIG. 3, a supporting shaft portion 22*b* is fitted into a cylindrical member 57. The cylindrical member 57 is inserted into a release plate 54. Second ratchets 45 are pivotally mounted on a surface of the second large gear 36. The second ratchet 45 is urged by a second return spring 46 such that a free end thereof is directed radially inwardly of the second large gear 36. A friction spring 58 provided on an outer periphery of the cylindrical member 57 urges the release plate 54 in such a manner as to produce a frictional force between the second large gear 36 and the release plate 54.

Figure 9A:
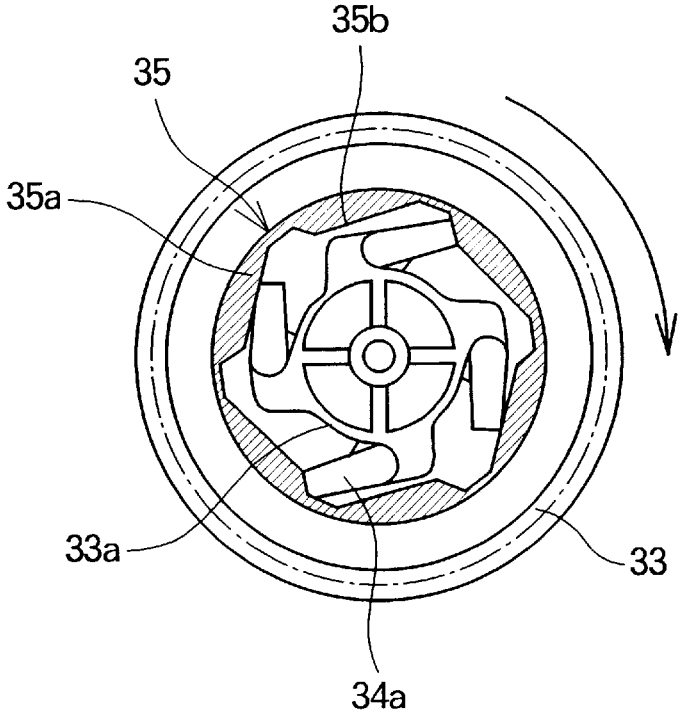
FIGS. 9A and 9B are enlarged cross-sectional views taken along line 9—9 of FIG. 3, showing an operation of a first one-way clutch upon starting a starter motor and the operation of the same upon starting a recoil starter mechanism, respectively.
Figure 9B:
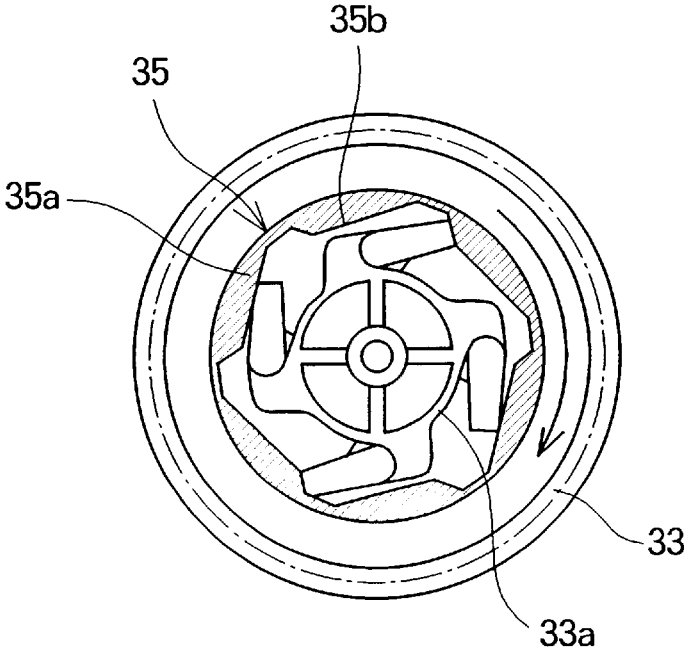

The first one-way clutch 34 is provided radially inwardly of the first large gear 33 meshed with the first small gear 32 and rotatably provided on the first intermediate shaft 51. As shown in FIGS. 9A and 9B, plural step portions 35*b* each having a gentle slope and an upright surface are formed on an inner periphery of a cylinder portion 35*a* formed integrally with the back side of the second small gear 35 rotatably provided on the first intermediate shaft 51. Also, on an outer periphery of a cylinder portion 33*a* integrally formed in the vicinity of the center of the first large gear 33 and protruding toward the second small gear 35, there are provided plural first ratchets 34*a*. The ratchet 34*a* includes a free end urged radially outwardly of the cylinder portion 33*a* by a first return spring 34*b*.

The second one-way clutch 44 for allowing and disallowing transmission of rotation of the rope winding pulley 42 to the second large gear 36 serving as the final gear is constructed as discussed below.

Figure 10A:
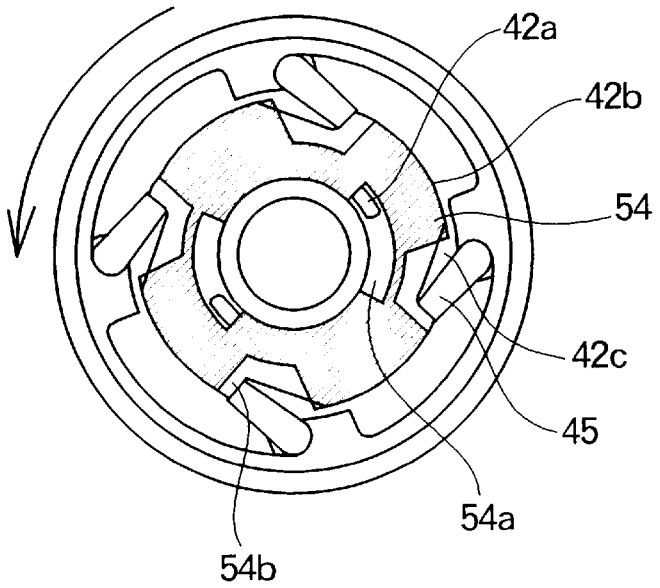
FIGS. 10A and 10B are enlarged cross-sectional views taken along line 10—10 of FIG. 3, showing an operation of a second one-way clutch upon starting the recoil starter mechanism and the operation of the same when a starting rope is wound on the rope winding pulley after starting of the recoil starter mechanism, respectively.
Figure 10B:
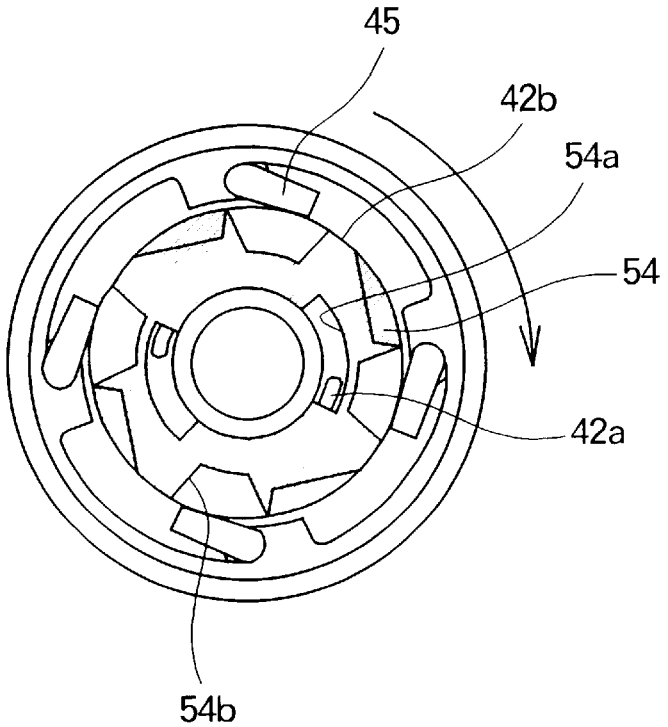

In other words, on the back side of the rope winding pulley 42, there are formed projections 42*a* fitted into elongated apertures 54*a* formed in the release plate 54 urged by the friction spring 58 in such a manner as to produce a frictional force between the release plate 54 and the second large gear 36, as shown in FIGS. 10A and 10B. A plurality of cutout grooves 54*b* are formed on an outer periphery of the release plate 54. On an outer peripheral surface of a cylinder portion 42*b* of the rope winding pulley 42, groove portions 42*c* each having a gentle slope and an upright surface are formed in correspondence to the cutout grooves 54*b*. The second ratchet 45 is urged by the second return spring 46 with the free end thereof directed radially inwardly of the second large gear 36 to thereby allow engagement between the free end and the groove portion 42*c* of the cylinder portion 42*b* of the rope winding pulley 42.

The coupling 16 connected to the crankshaft 1*a* (see FIG. 8) is connected to the output shaft 38 through the third one-way clutch 17. Namely, before the engine body 1*b* is started, ratchets 17*b* with their free ends urged radially inwardly of the coupling 16 by a spring 17*a* provided on the coupling 16 are engaged with the output shaft 38 comprising a cam. When the output shaft 38 is rotated to start the engine, a centrifugal force generated by a high-speed rotation of the coupling 16 acts on the ratchets 17*b* to thereby urge the ratchets 17*b* radially outwardly against the force of the spring 17*a* with the result that the ratchets 17*b* are disengaged from the output shaft 38.

Next, a manner of starting the engine with the self-starter mechanism or the recoil starter mechanism will be described below.

Referring to FIG. 3, and FIGS. 9A and 9B, when the starter motor 31 is rotated, the first large gear 33 is rotated by means of the first small gear 32 mounted on the output shaft 31*a*. Upon rotation of the first large gear 33, the first ratchet 34*a* of the first one-way clutch 34 is then urged radially outwardly by the action of the first return spring 34*a* to thereby bring the free end of the first ratchet 34*a* into engagement with the upright surface of the step portion 35*b* of the second small gear 35, thereby rotating the second small gear 35 together with the first large gear 33.

Such a rotation of the second small gear 35 is transmitted to the second large gear 36. At this time, because the second large gear 36 is rotated in a direction as indicated by an arrow in FIG. 10A, the rope winding pulley 42 is not rotated, whereupon the rotation of the starter motor 31 is transmitted to the coupling 16 via the ratchet 17*b* and the output shaft 38 comprising the cam correlated to the former, thereby starting the engine.

Now, a manner of starting the engine with the recoil starter mechanism 40 will be described in relation to FIG. 3, and FIGS. 10A and 10B.

First, when the starting rope 41 is unwound by pulling the lever 47 shown in FIG. 1 with a hand, the rope winding pulley 42 is rotated to move the projections 42*a* in the elongated apertures 54*a* of the release plate 54 retained by the friction spring 58. The projections 42*a* are then engaged with the ends of the elongated apertures 54*a* to thereby bring the cutout groove 54*b* on the outer periphery of the release plate 54 into alignment with the groove portion 42*c* formed in the cylinder portion 42*b*. Thereafter, the free end of the second ratchet 45 is fitted into the groove portion 42*c* to thereby come into abutment against the upright surface of the groove portion 42*c*. The second large gear 36 is therefore rotate d together with the rope winding pulley 42 to thereby start the engine by means of the output shaft 38, the ratchet 17*b* engaged with the output shaft 38, and the coupling 16. When the engine is started to disengage the output shaft 38 from the ratchet 17*b* while the rope winding pulley 42 is rotated by the rope return spring 43 in a such direction as to wind the starting rope 41 thereon, the projections 42*a* are moved within the elongated apertures 54*a* in the direction opposite to that in FIG. 10A, as shown in FIG. 10B. Consequently, the cutout grooves 54*b* of the release plate 54 come out of alignment with the groove portions 42*c* of the cylinder portion 42*b*, whereby the second ratchet 45 is slid on the outer periphery of the cylinder portion 42*b*. Although the rotation of the second large gear 36 is then transmitted to the second small gear 35, the second sm all gear 35 is rotated in a direction as indicated by an arrow of FIG. 9B with the result that the rotation of the second small gear 35 is not transmitted to the first large gear 33.

Once the engine is started by the starter motor 31 or otherwise the recoil starter mechanism 40, the ratchet 17*b* is urged radially outwardly due to a high-speed rotation of the coupling 16 to thereby disengage from the output shaft 38 comprising the cam and hence the starter motor 31 and the recoil starter mechanism 40 are not influenced by the rotation of the coupling 16.

In the embodiment as stated above, the engine starting apparatus 20 can be mounted to the engine 1 notwithstanding a configuration of the engine 1 or a form of setting the same. For example, the engine starting apparatus 20 may be attached to a vertically arranged engine besides the horizontally arranged engine.

Further, the output shaft 38 of the engine starting apparatus 20 may be directly connected to the crankshaft 1*a*. Furthermore, the generator 11 is optionally provided.

Obviously, various minor changes and modifications of the present invention are possible in the light of the above teaching. It is therefore to be understood that within the scope of the appended claims, the present invention may be practiced otherwise than as specifically described.

What is claimed is:

1. An engine starting apparatus comprising: a case comprised of a cup-shaped outer case and a substantially sheet-shaped case cover attached to the outer case, the outer case and the case cover jointly defining a space; a self-starter mechanism disposed within the space of the case for starting; an engine; a motor mounting seat disposed in the case for mounting thereon a starter motor of the self-starter mechanism; a plurality of first louvers disposed proximate the motor mounting seat and extending from the case cover toward the engine; and a plurality of second louvers formed on a wall portion of the outer case and extending from the outer case toward the engine; wherein external air is taken in by the first and second louvers around the entire periphery of the case during operation of the engine.

2. An engine starting apparatus as claimed in claim 1; further comprising three bolt apertures formed in the case for attaching the case to the engine, the bolt apertures being disposed around the periphery of the case and spaced apart by 120 degrees around a same pitch circle of the periphery of the case.

3. An engine starting apparatus as claimed in claim 2; wherein the three bolt apertures comprise first, second and third bolt apertures; and further comprising a recoil starter mechanism having a starting rope pulling port disposed adjacent to the first bolt aperture, the starter motor of the self-starter mechanism being selectively disposed either between the first bolt aperture and the third bolt aperture when the starting rope pulling port is positioned between the first bolt aperture and the second bolt aperture, or between the first bolt aperture and the second bolt aperture when the starting rope pulling port is positioned between the first bolt aperture and the third bolt aperture.

4. An engine starting apparatus as claimed in claim 1; further comprising a recoil starter mechanism, a gear forming a part of the self-starter mechanism and a rope winding pulley of the recoil starter mechanism being disposed closely to and coaxially with each other, the rope winding pulley being surrounded by a peripheral wall portion extending from an inner surface of the case, the gear having a flange formed on a side end of teeth thereof facing the rope winding pulley, the peripheral wall portion extending so that an end thereof is disposed closely to the flange.

5. An engine starting apparatus as claimed in claim 1; further comprising a recoil starter mechanism accommodated in the case; a first one-way clutch provided in a gear train for transmitting rotation of an output shaft of the starter motor to a crankshaft of the engine; and a second one-way clutch provided in a transmission mechanism for transmitting rotation of a rope winding pulley of the recoil starter mechanism to the crankshaft; wherein the first one-way clutch comprises a small gear having step portions on an inner peripheral surface thereof, and a large gear having ratchets urged to mesh with the step portions only when the large gear is rotated in such a direction so as to start the engine.

6. An engine starting apparatus as claimed in claim 5; wherein the first one-way clutch is provided radially internally of the large gear and operated simultaneously with another small gear serving as a decelerating gear attached to an output shaft of the starter motor.

7. An engine starting apparatus as claimed in claim 5; wherein the second one-way clutch includes a cylinder portion having axially protruding projections on a back side of the rope winding pulley of the recoil starter mechanism and groove portions formed on an outer periphery of the rope winding pulley, and another large gear having a release plate with elongated apertures into which the projections are fitted and having ratchets urged to mesh with the groove portions only when the rope winding pulley is rotated in such a direction so as to start the engine.

8. An engine starting apparatus comprising: a case attachable to an engine, the case defining an inner space for accommodating a starter; a motor mounting seat formed in the case for mounting thereon a starter motor of a self-starter mechanism; a plurality of first louvers formed around a portion of the periphery of an inner wall of the case proximate the motor mounting seat and extending from the inner wall of the case toward the engine; and a plurality of second louvers formed on an outer wall of the case and extending from the case toward the engine, the second louvers being formed around a portion of the periphery of the outer wall of the case at portions of the periphery of the case at which the first louvers are not formed; wherein external air is taken in by the first and second louvers around the entire periphery of the case during operation of the engine.

9. An engine starting apparatus according to claim 8; wherein the case comprises a cup-shaped outer case and a substantially sheet-shaped case cover attached to the outer case, the outer case and the case cover jointly defining the space and the engine being positioned outside the case cover.

10. An engine starting apparatus according to claim 9; wherein the inner wall of the case comprises an inner surface of the case cover facing the engine and the outer wall of the case comprises an outer surface of the cup-shaped outer case opposite the engine.

11. An engine starting apparatus according to claim 8; further comprising a plurality of bolt apertures formed in the case for attaching the case to the engine, the bolt apertures being disposed around the periphery of the case and spaced equidistant from each other.

12. An engine starting apparatus according to claim 11; wherein the plurality of bolt apertures comprises three bolt apertures spaced apart by 120 degrees around a same pitch circle of the periphery of the case.

13. An engine starting apparatus according to claim 8; further comprising a recoil starter mechanism disposed in the case.

14. An engine starting apparatus according to claim 8; further comprising a recoil starter mechanism disposed in the case, the recoil starter mechanism having a starting rope pulling port disposed adjacent to a first bolt aperture, the starter motor being disposed between the first bolt aperture and a third bolt aperture when the starting rope pulling port is positioned between the first bolt aperture and a second bolt aperture, the starter motor being disposed between the first bolt aperture and the second bolt aperture when the starting rope pulling port is positioned between the first bolt aperture and the third bolt aperture.

15. An engine starting apparatus according to claim 8; further comprising a recoil starter mechanism disposed in the case, a final gear forming a part of the self-starter mechanism and a rope winding pulley of the recoil starter mechanism being disposed closely to and coaxially with each other, the rope winding pulley being surrounded by a peripheral wall portion extending from an inner surface of the case, the final gear having a flange formed on a side end of teeth thereof facing the rope winding pulley, the peripheral wall portion extending so that an end thereof is disposed closely to the flange.

16. An engine starting apparatus according to claim 15; wherein the peripheral wall portion and the flange formed on the final gear are spaced by a distance smaller than the diameter of a rope wound around the rope winding pulley so that the rope cannot pass through the space therebetween.

17. An engine starting apparatus according to claim 16; wherein the peripheral wall portion and the flange formed on the final gear form a labyrinth structure to prevent oil from passing through the space between the peripheral wall portion and the flange.

18. An engine starting apparatus according to claim 8; further comprising a recoil starter mechanism accommodated in the case; a first one-way clutch provided in a gear train for transmitting rotation of an output shaft of the starter motor to a crankshaft of the engine; and a second one-way clutch provided in a transmission mechanism for transmitting rotation of a rope winding pulley of the recoil starter mechanism to the crankshaft; wherein the first one-way clutch comprises a small gear having step portions on an inner peripheral surface thereof, and a large gear having ratchets urged to mesh with the step portions only when the large gear is rotated in such a direction as to start the engine.

19. An engine starting apparatus according to claim 18; wherein the first one-way clutch is provided radially internally of the large gear and operated simultaneously with another small gear serving as a decelerating gear attached to an output shaft of the starter motor.

20. An engine starting apparatus according to claim 18; wherein the second one-way clutch includes a cylinder portion having axially protruding projections on a back side of the rope winding pulley of the recoil starter mechanism and groove portions formed on an outer periphery of the rope winding pulley, and another large gear having a release plate with elongated apertures into which the projections are fitted and ratchets urged to mesh with the groove portions only when the rope winding pulley is rotated in such a direction as to start the engine.

21. An engine starting apparatus for starting an engine, comprising: a case comprised of an outer case and a case cover defining an interior space, the outer case having at least first, second and third bolt apertures for attaching the case to an engine; a motor mounting seat provided in an inner wall of the outer case for mounting thereon a starter motor for starting the engine; a recoil starter mechanism disposed in the interior space of the case for starting the engine, the recoil starter mechanism having a starting rope pulling port disposed adjacent to the first bolt aperture, the starter motor being selectively disposed either between the first bolt aperture and the third bolt aperture when the starting rope pulling port is positioned between the first bolt aperture and the second bolt aperture, or between the first bolt aperture and the second bolt aperture when the starting rope pulling port is positioned between the first bolt aperture and the third bolt aperture; a plurality of first louvers extending from an outer surface of the case cover; and a plurality of second louvers formed on a wall of the outer case; wherein external air is taken in by the first and second louvers around the entire periphery of the case during operation of the engine.

22. An engine starting apparatus according to claim 21; wherein the bolt apertures are disposed cicumferentially on the outer case at 120° intervals.

23. An engine starting apparatus according to claim 21; wherein the recoil starter mechanism has a rope winding pulley; and further comprising a gear train having a first one-way clutch for transmitting rotation of an output shaft of the starter motor to a crankshaft of the engine, and a transmission mechanism having a second one-way clutch for transmitting rotation of the rope winding pulley of the recoil starter mechanism to the crankshaft.

24. An engine starting apparatus according to claim 23; wherein the first one-way clutch comprises a first gear having step portions on an inner peripheral surface thereof, and a second gear having ratchets urged to mesh with the step portions only when the second gear is rotated in such a direction so as to start the engine.

25. An engine starting apparatus according to claim 24; wherein the first one-way clutch is provided radially internally of the second gear; and further comprising a third decelerating gear connected to an output shaft of the starter motor for undergoing simultaneous movement with the second gear.

26. An engine starting apparatus according to claim 2; wherein the second one-way clutch has a cylinder portion having axially protruding projections on a back side of the rope winding pulley of the recoil starter mechanism and groove portions formed on an outer periphery of the rope winding pulley, and a gear having a release plate with apertures into which the projections are fitted and having ratchets urged to mesh with the groove portions only when the rope winding pulley is rotated in such a direction so as to start the engine.

* * * * *